US011389935B1

(12) United States Patent
Emerick

(10) Patent No.: US 11,389,935 B1
(45) Date of Patent: Jul. 19, 2022

(54) SELF-ADJUSTING DEEP WELL SOCKET

(71) Applicant: Trevor W. Emerick, Butler, PA (US)

(72) Inventor: Trevor W. Emerick, Butler, PA (US)

( * ) Notice: Subject to any disclaimer, the term of this patent is extended or adjusted under 35 U.S.C. 154(b) by 300 days.

(21) Appl. No.: 16/739,018

(22) Filed: Jan. 9, 2020

Related U.S. Application Data

(63) Continuation-in-part of application No. 15/890,678, filed on Feb. 7, 2018, now abandoned.

(60) Provisional application No. 62/790,873, filed on Jan. 10, 2019, provisional application No. 62/457,589, filed on Feb. 10, 2017.

(51) Int. Cl.
*B25B 23/10* (2006.01)
*B25B 23/00* (2006.01)
*B25B 13/10* (2006.01)

(52) U.S. Cl.
CPC ..... *B25B 23/108* (2013.01); *B25B 13/10* (2013.01); *B25B 23/0035* (2013.01)

(58) Field of Classification Search
CPC .... B25B 23/108; B25B 23/0035; B25B 13/10
USPC ..... 81/125, 128
See application file for complete search history.

(56) References Cited

U.S. PATENT DOCUMENTS 58,306 A * 9/1866 Sedgwick ..... B25B 13/44 81/128
5,893,306 A * 4/1999 Owoc ..... B25B 13/461 81/60
7,707,916 B2 * 5/2010 Pirseyedi ..... B25B 13/44 279/64
2006/0042424 A1 * 3/2006 Pirseyedi ..... B25B 13/44 81/163
2021/0367375 A1 * 11/2021 Anderson ..... H01R 13/639

* cited by examiner

*Primary Examiner* — Hadi Shakeri
(74) *Attorney, Agent, or Firm* — Karen Tang-Wai Sutton

(57) ABSTRACT

An adjustable-size socket formed as a pair of coaxial tubes in rotatable relationship to one another, the innermost tube having a limited directional distance and independently rotational relationship with the outer tube by rotating along a mated set of threaded structures on immediately adjacent sides of the coaxial pair of tubes. The inner tube is a deep well chamber having a tool receiving end and a fastener receiving end, with an annular array of independently pivotable fingers arranged about an internal perimeter of the inner tube at the fastener receiving end. Rotation of the inner tube pushes a lowermost portion of the inner tube against the fingers, pushing them into the deep well chamber and around an irregularly shaped bolt or nut style fastener, gripping the fastener and allowing a user to remove or reinstall the fastener. The fingers self-adjust around the fastener.

17 Claims, 9 Drawing Sheets

SELF-ADJUSTING DEEP WELL SOCKET

CROSS REFERENCE TO RELATED APPLICATIONS

Reference is made to and priority claimed from U.S. provisional application Ser. No. 62/790,837 filed 10 Jan. 2019, and to U.S. application Ser. No. 15/890,678 filed 7 Feb. 2018, which itself claimed priority to U.S. provisional application Ser. No. 62/457,589 filed 10 Feb. 2017, all of which are hereby incorporated by reference.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The invention pertains to the field of hand tools for fastening and unfastening bolts and nuts, and specifically to a self-adjusting socket used with a conventional socket wrench used to remove bolt and/or nut fasteners whose original hexagonal head and/or body is damaged or otherwise irregularly shaped and not removable using conventional prior art hand tools.

Background Art

Bolts and their corresponding mating nuts are common fasteners used in a variety of applications. These useful fasteners are typically formed with a hexagonal-shaped head, in the case of a bolt, or a hexagonal-shaped body with a threaded central hole, in the case of a nut, fastened and unfastened using wrenches. For a classic crescent wrench, or adjustable wrench, the ability of the wrench to securely fasten to the nut or bolt head is heavily dependent on the fastener having flat, parallel opposed surfaces against which the pair of wrench jaws can apply strong pressure in order to grip the fastener and turn it. The hexagonal-shaped head or body of the fastener increases the number of useful flat gripping surfaces.

Specialized socket wrenches that lock into cylindrical sockets formed with a hexagonal central bore are another standard wrench design that is particularly useful because the hexagonal shape of the fastener allows maximum torque and grip when used with the socket and socket wrench. A typical socket wrench set comes with many different socket sizes, each socket sized to fit over a standard bolt or nut size, with minimal play in the fit, and can be used in tight spaces where the ratcheting motion of the socket wrench minimizes the clearance required as compared to a standard wrench that can only at most grip two sides of the fastener. The socket itself allows the user to more stably grip the fastener. Sockets are selected to match the size of the fastener to be fastened or unfastened, positioned over the fastener, and the wrench is inserted into the wrench end of the socket and turned accordingly.

Unfortunately, the hexagonal-shaped nuts and bolt heads often suffer corrosion and other physical damage particularly when exposed to the elements, and removal using standard socket wrenches and sockets is challenging because the socket cannot tightly grip any of the sides of the damaged nut or bolt when irregularly shaped and smaller than the correct sized socket. The socket will turn without gripping the fastener, further damaging the hexagonal shape and potentially damaging the interior of the socket. Currently, sockets are not size or shape adjustable either, so a damaged nut or bolt head is often too small for the "correctly" sized socket, and too large for the next sized socket. The irregular shape of the fastener also often means that conventional wrenches are difficult to use to loosen these damaged fasteners, again because even a conventional wrench must be able to firmly grip two sides of the fastener, and it cannot do so easily if any of the sides are irregularly shaped, or rounded because of limited gripping contact between fastener and wrench.

An additional common problem using socket wrench sets is that a fastened bolt or nut is often so tightly fastened that the socket placed over the bolt or nut has a tendency to ride upwards and damage the hexagonal sides of the fastener when attempting to remove it, creating an irregular shape or further damaging the fastener so that it is difficult to grasp using conventional hand tools. Currently, sockets are simply metal cylinders with hexagonal shaped cores that provide no other gripping other than relying on the shape of the socket being fractionally larger than the fastener so that all sides of the fastener are engaged by all sides of the socket, which allows a socket to be slide easily over a fastener, but does nothing to otherwise secure the socket to the fastener.

Yet another common issue occurs when the damaged fastener is a nut threaded tightly onto a long bolt, and the bolt shank protrudes from the nut. A socket from a socket set must be long enough to accommodate the length of the shank when placed over it, and often especially when the nut is located in a tight spot, only a socket and socket wrench can remove it. Currently, when faced with this situation, often the only solution is to cut off the bolt shank with a saw, and/or drill out the bolt. In certain cases, the fastener cannot be removed without ultimately damaging the fastened parts. This is a common problem with plumbing fixtures, where toilet bolts notoriously corrode and become difficult or impossible to remove because of a lack of clearance space for a drill, and with lawn mowers, where interior fasteners inside the cutting deck are so badly corroded and damaged that the only option for removal is by being drilled out. The hexagonal-shaped fastener is thus optimally and easily fastened using a socket and socket wrench, and irritatingly unfastened using an assortment of drills, saws, hammers, spray lubricants, etc.

What is needed is a new socket that can effectively and securely grab deformed or otherwise irregular shaped fasteners as well as undamaged hexagonal-shaped fasteners to allow easy removal by conventional socket wrenches.

DISCLOSURE OF INVENTION

The invention is a self-adjusting deep well socket having an external case body and a coaxial case insert, the coaxial body and insert threadably and rotatably mating such that the case insert rotates inside the case body along the mated threads. The case insert is further comprised of a tool receiver end sized and shaped to receive a drive square of a socket wrench, an opposed fastener receiver end sized and shaped to receive a threaded fastener, such as an approximately hexagonal shaped bolt head, and a deep well chamber extending from the tool receiver end to the opposed fastener receiving end. At the fastener receiving end, a plurality of independently pivoting fingers in an annular array are positioned inside the case insert. The plurality of independently pivoting fingers can move inwards into the deep well chamber and also out of the deep well chamber into a finger channel formed by a gap existing between the exterior wall of the case insert and the interior wall of the case body. Rotating the case insert downwards, by inserting the drive square of the prior art socket wrench, causes a lowermost tip of the case insert to push against the plurality of fingers, pushing them out of the finger chamber and into the deep well chamber. When an irregularly shaped fastener is positioned inside the deep well chamber, each finger of the plurality of fingers pivots independently of each other finger against the fastener's sides, with some fingers moving relatively further into the deep well chamber as compared to other fingers in a same array to accommodate the irregularly shaped fastener. As the case insert is turned and moved further down into the finger chamber, the plurality of fingers tighten around the fastener until they can no longer be moved into the deep well chamber. At this point, the fastener can be removed (unfastened) or reapplied (refastened), as the case may be.

In another aspect of the invention, to maintain a tight grip of the plurality of fingers around a fastener in the deep well chamber, the self-adjustable socket includes a toothed switch that travels inside a slot formed in the case body and slideably inserts between a fluted section having a plurality of adjacent recesses about a perimeter of the case insert that is less than the total perimeter of the case insert and an open channel formed directly adjacent the fluted section. Positioning the toothed switch in the fluted section allows the fingers to be optimally tightened against the fastener in the deep well chamber and locked into position. Sliding the switch into the open channel allows the case insert to be rotated upwards to release the fingers.

In yet another aspect of the invention, a wrench grip is provided on an exterior of the case body having at least one pair of opposed, flat, spaced apart parallel sides allowing a wrench to be positioned on the wrench grip. When a fastener is to be removed, the deep well chamber is positioned over the fastener, the drive square of the socket wrench is positioned into the tool receiver, and a crescent wrench is positioned on the wrench grip. A user simultaneously turns the socket wrench counterclockwise and the crescent wrench clockwise, tightening the fingers about the fastener. The toothed switch is moved into the fluted section either before or after turning the respective wrenches. If the toothed switch is positioned inside the fluted section prior to turning, the tooth moves between adjacent recesses of the fluted section until it can move no further. If the tooth starts in the open channel when the respective wrenches are turned, the tooth is then moved into the fluted section to secure the finger position around the fastener. Then, to continue to remove the fastener, the socket wrench is turned in a counterclockwise motion as normal, and the fastener turns and is removed. The fastener can then be discarded and a new undamaged fastener used, or optionally can be reapplied using the self-adjusting socket but turning the gripped fastener secured in the self-adjusting socket in a clockwise direction.

In still yet another aspect of the invention, the self-adjusting socket is a universal socket where the diameter of the deep well chamber, the fingers, and the finger chamber are such that the socket can replace the gripping capability of two or more prior art standard socket sizes. Hence a prior art socket set having four sockets sized ¼ inch, ⅜ inch, ½ inch and ¾ inch can be replaced by a new set having just 2 sockets, a first socket covering fasteners ranging from ¼ inch to ⅜ inches in diameter and a second socket covering fasteners ranging from ½ inch to ¾ inches and so on.

In still yet another aspect of the invention, the self-adjusting socket's mating threads can be a left handed thread or a right handed thread without loss of functionality.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
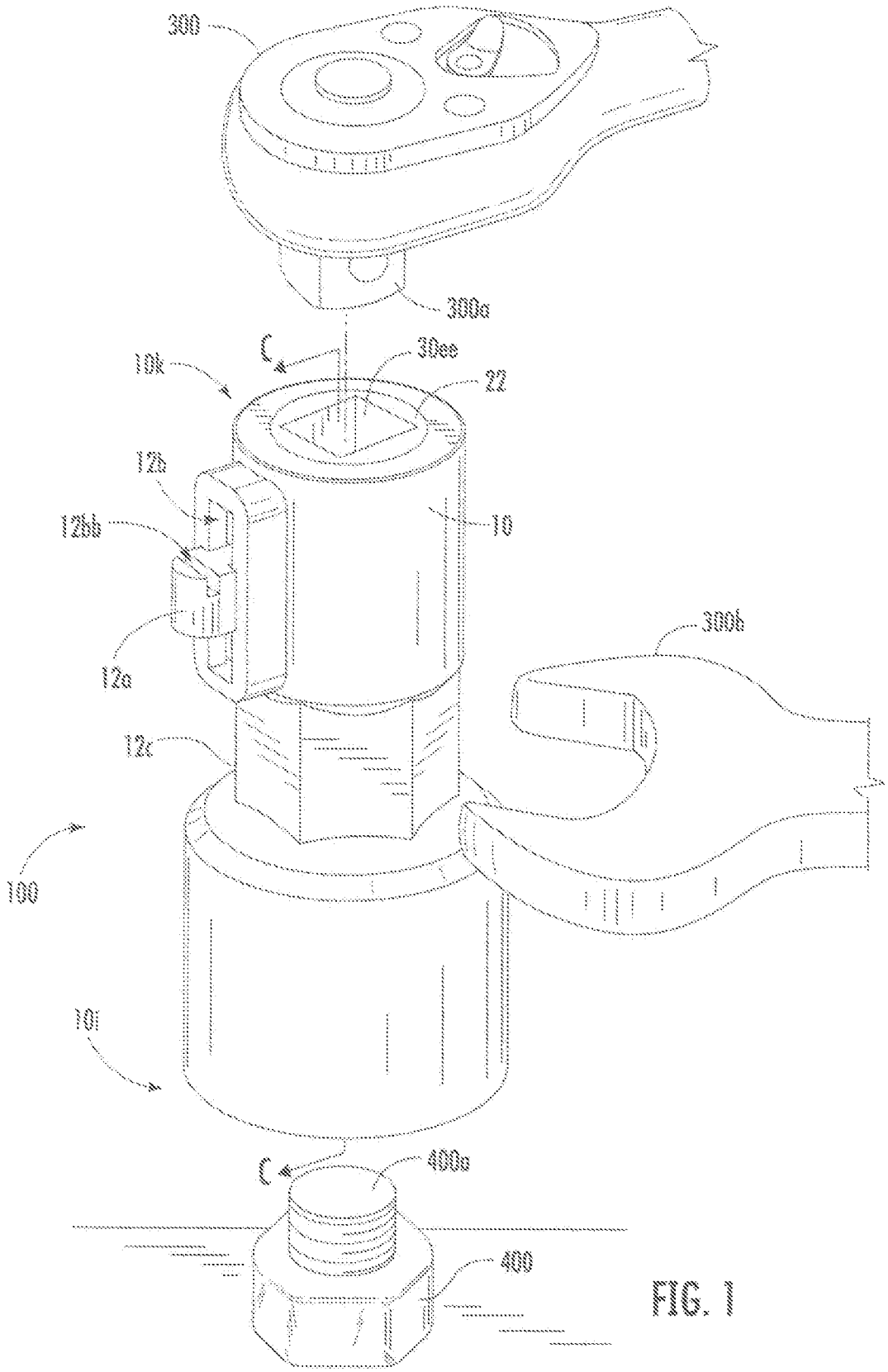
FIG. 1 is a perspective view of a self-adjusting deep well socket according to the invention, shown in a partially exploded view with a prior art fastener, prior art socket wrench and prior art crescent wrench.

The following is a list of reference labels used in the drawings to label components of different embodiments of the invention, and the names of the indicated components:

100 self-adjusting deep well socket or socket
10 case body
10*c* main body cavity or deep well chamber
10*e* finger
10*eg* gripping side
10*ec* channel side
10*i* fastener end of case
10*k* tool end or wrench end of case
12*a* switch
12*ab* switch tooth or tooth
12*bb* switch groove
12*b* switch slot
12*c* wrench or tool grip
14*a* finger channel
14*b* case body mating threads
22 case insert
22*a* case insert mating threads
22*b* fluted section
22*c* upper ring
22*d* arm
22*e* pin
22*ek* hole
22*f* tip of case insert
22*g* open channel
22*h* annular plate
22*i* finger support
22*j* finger bay
22*k* finger hole
30*e* top opening
30*ee* tool receiver (socket drive square receiver)
300 prior art socket wrench
300*a* drive square of prior art socket wrench
300*b* crescent wrench grip or wrench grip
400 fastener
400*a* threaded fastener receiver

DETAILED DESCRIPTION

A self-adjusting deep well socket or socket 100 according to the invention is described in FIGS. 1-13. Turning to FIG. 1, the socket 100 is shown with a prior art socket wrench 300, a prior art crescent wrench 300*b*, and a prior art fastener 400, the fastener depicted as a hexagonal nut threaded onto a threaded portion of a rod or a thread of a bolt. The prior art tools and fastener are included to illustrate how the socket 100 is used and are not part of the invention. The term fastener in this disclosure refers to a part of a fastener, here the bolt head and/or nut, that is gripped by the prior art wrench or other tool and turned to install or remove the fastener. Fastener thus refers to only that part that is actively gripped when installing or removing a bolt or nut, and does not refer to a shank or the thread of the bolt, for instance. The term deep well refers to a type of socket that is long relative to its width, and has an interior cavity with a length designed to allow the socket to accommodate the thread and/or the shank of the bolt, as shown in FIG. 1, inside the cavity. Deep well thus does not define a particular length or size other than to describe the socket as being able to accommodate relatively long threads or shanks, spanning a couple of inches to several feet or more in some applications.

Turning now to the Figures, the socket 100 has four main parts: a case body 10, a case insert 22, a finger support 22*i*, and a switch 12*a*.

Figure 3:
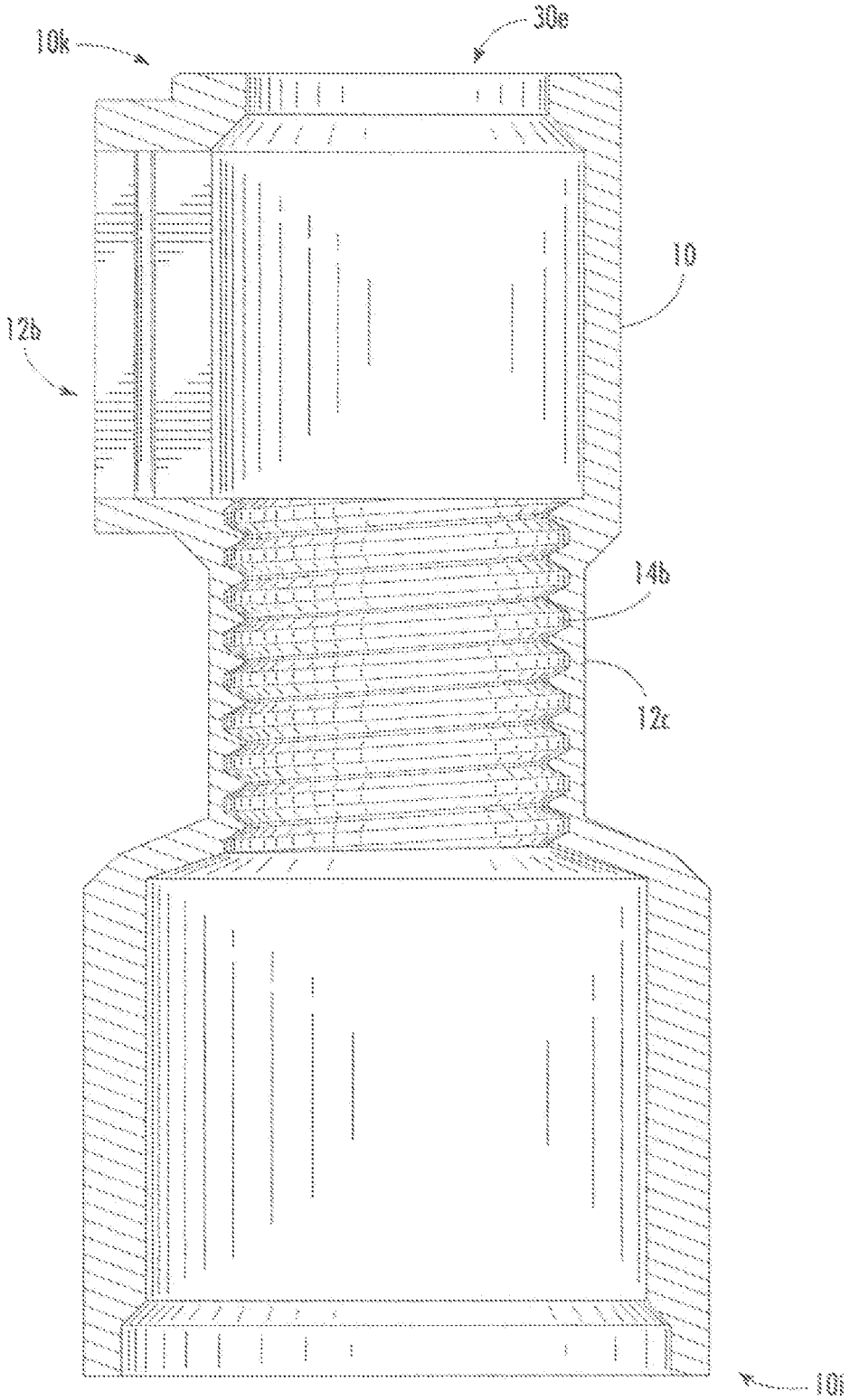
FIG. 3 is a side elevation, cross sectional view of the case body taken along lines A-A in FIG. 2.

Looking at FIGS. 1 and 3, the case body 10 is a tubular housing with a top opening 30*e* at a wrench end 10*k* and an opposed bottom opening or fastener end 10*i*, with a hollow cavity spanning between the ends 30*e* 10*i*, the hollow cavity sized and shaped to receive the case insert 22. Mating threads 14*b* are formed long an inside wall of the case body 10 mateable with complementary mating threads 22*a* formed on a portion of an exterior wall of the case insert 22; the case insert 22 and case body 10 thus have a rotational, coaxial relationship with the case insert 22 rotating up and down along the mated threads inside the case body 10. The case body 10 is further formed with a tool grip 12*c*, shown in FIG. 1 as a constricted area with an approximately hexagonal shape formed centrally into the case body and having a plurality of flat sides adapted to be gripped by the prior art crescent wrench 300*b*. It should be noted that in this disclosure, references to the prior art crescent wrench 300*b* are meant to include other prior art tools such as pliers adapted to grasp and turn fasteners. In the Figures, the external case body 10 shape is roughly hourglass or pear-shaped, with the tool grip 12*c* being a narrowest diameter of the case body 10, however the inventor notes that the shape of the tool grip 12*c* can in fact be an entirety of the exterior case body shape, or otherwise be simplified so as to have at least two parallel, opposed flat sides, and thus the exterior shape of the case body shown in the Figures is not meant to limit the shape of the case body to what is shown, or limit the tool grip to hexagonal or roughly tubular shapes but rather to show some examples and suggestions of useful shapes allowing use of the prior art crescent wrench 300*b* with the socket 100, and that are additionally decorative and pleasing to the eye. The inventor expects that relatively smaller sockets will have an exterior shape approximating a hexagonal tube, and relatively larger sockets will be more hourglass or pear-shaped to provide additional room to accommodate relatively larger sized fasteners and shanks or threads, particularly those used for specialty applications such as for industrial cranes, construction equipment and the like, where large bolts with diameters of 12 inches or more will need respectively larger sockets.

A switch slot 12*b* is an elongated slot formed on the case body 10, sized and shaped so as to receive the switch 12*a* and positioned on the case body so as to allow the switch 12*a* to move up or down inside the slot 12*b* and engage either a recess of a fluted section 22*b* or an open channel 22*g* formed beneath the fluted section of the case insert 22. The slot 12*b* must be of a sufficient vertical length so as to allow the switch 12*a* access to the fluted section 22*b* when the switch is positioned in an uppermost position, as well as access to the open channel 22*g* when the switch is in the lowermost position within the slot 12*b*. In the Figures, the slot 12*b* is shown with a raised perimeter wall, allowing the immediately adjacent exterior wall of the case body 10 to be reduced in overall size. In other embodiments, not shown, there is no raised perimeter wall and the case body then typically approximates an hourglass shape or other shape as aforementioned. The perimeter wall thus is a function of removing material on either side of the slot to reduce size, weight, and materials required.

The case insert 22 is a tubular structure with a hollow cavity or deep well chamber 10*c* spanning a top and bottom end of the case insert 22. A wrench insertion hole or tool receiver 30*ee* is formed into the top end, and is sized and shaped to receive a drive square 300*a* of the prior art socket wrench 300. The tool receiver 30*ee* is sized to accommodate standard drive square sizes such as one quarter inch and up, and can be sized to accommodate non-standard sizes or international sizes either by sizing up the tool receiver 30*ee* as needed or alternatively with appropriately-sized adaptors. When the case insert 22 is positioned inside the case body 10, as in FIG. 1, the tool receiver 30*ee* is positioned at the wrench end 10*k* of the case body 10. At the bottom end, a mouth of the deep well chamber 10*c* is wider in diameter as compared to the tool receiver 30*ee*, and sized and shaped to house the finger support 22*i*. The case insert 22, with its deep well chamber 10*c*, and the case body 10, with its hollow cavity, thus have a coaxial relationship, with the case insert 22 moving upwards or downwards inside the case body by rotating along the mated threads 14*b* 22*a*.

For the representative embodiment shown in the Figures, inserting the drive square 300*a* into the tool receiver 30*ee* and turning counterclockwise, or "lefty loosey", turns the case insert 22 within the case body 10 counterclockwise and moves a tip of the case insert 22*f* downwards towards the fastener end 10*i* of the case body 10. The case insert 22 in the Figures and most specifically in FIG. 7 has a reverse thread shown that mates with the threads of the case body 10, and can in fact turn clockwise or counterclockwise along the mated threads. The description herein is based on this relative thread configuration. The inventor notes that the relative thread direction for the case body and the case insert shown in the Figures can in fact be reversed, so that turning the case insert 22 counterclockwise rotates the case insert 22 upwards towards the tool receiver 30*ee*, without loss of functionality. The inventor notes that in certain applications, the ability to reverse the relative thread direction may be used to create two sets of sockets where appropriate: a first set for removing the fastener and a second set for replacing the fastener, and a relative thread direction of the case insert and the case body being the chief difference between each set.

Figure 2:
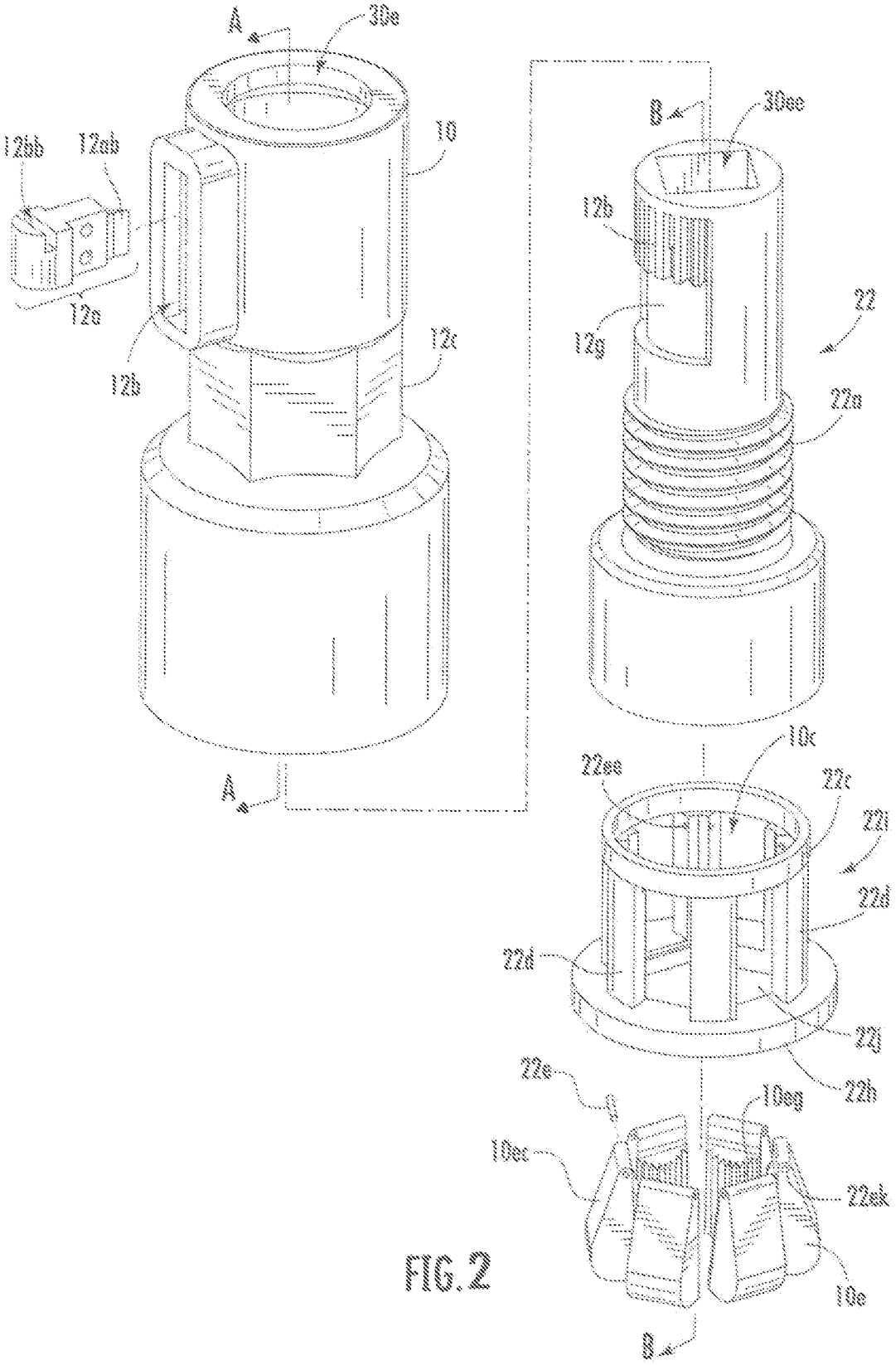
FIG. 2 is an exploded perspective view of a case body, a case insert, a finger support, and a plurality of fingers of the self-adjusting deep well socket.
Figure 4:
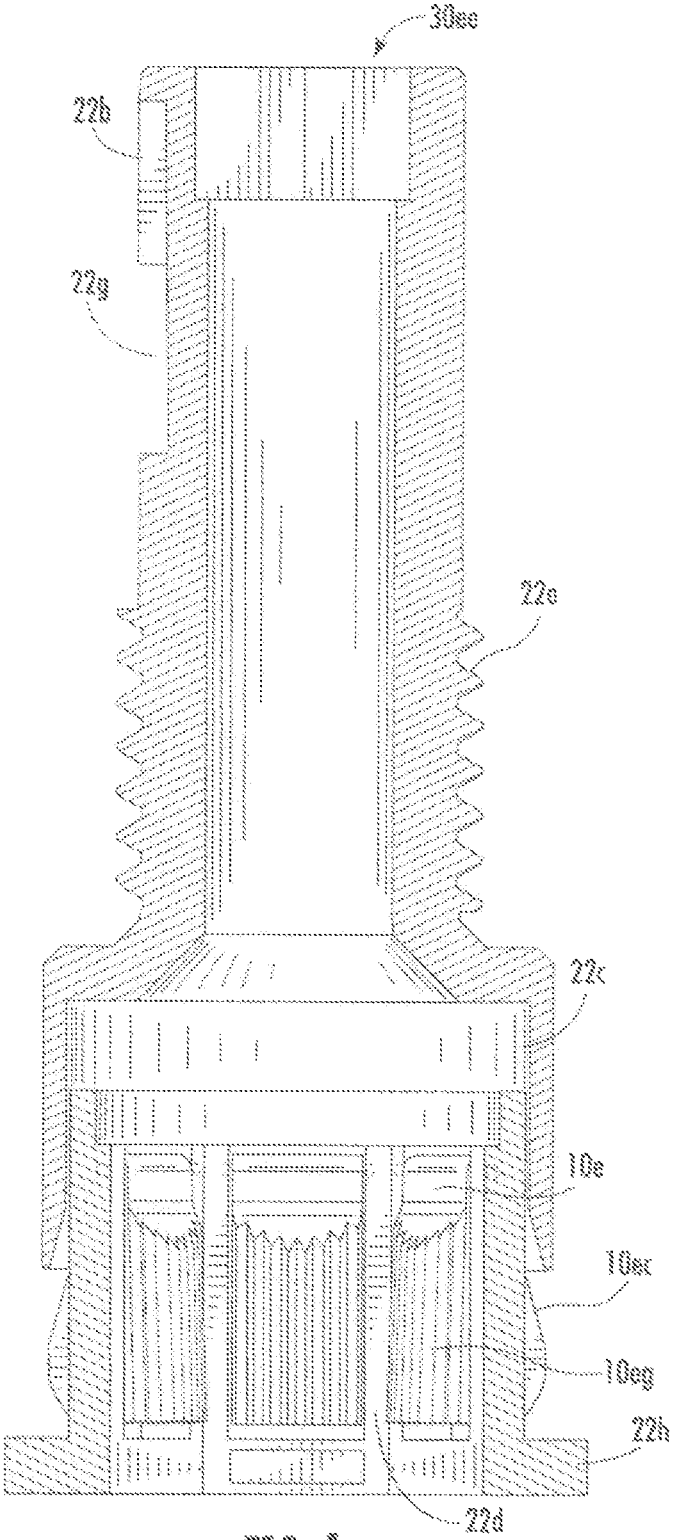
FIG. 4 is a side elevation, cross sectional view of the case insert in FIG. 1, taken along lines B-B in FIG. 2.
Figure 5:
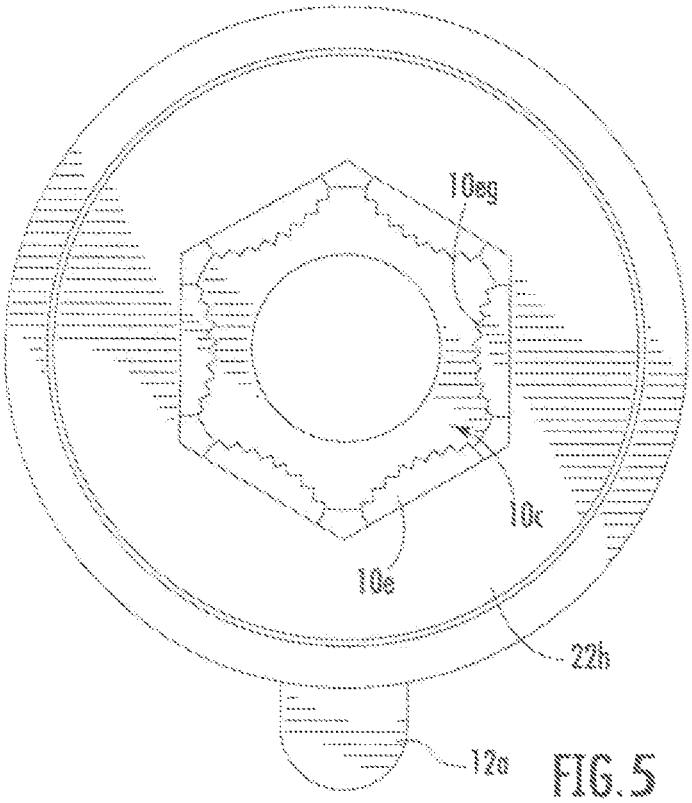
FIG. 5 is a bottom view of the self-adjusting deep well socket in FIG. 1.
Figure 6:
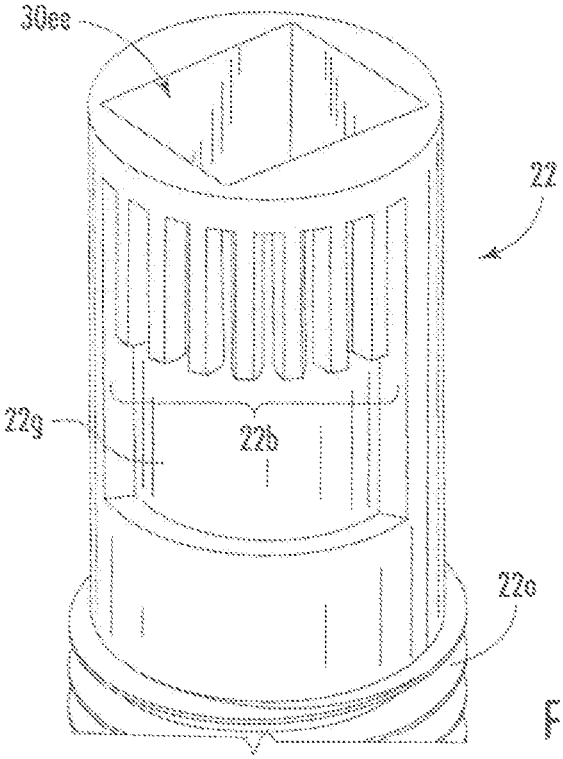
FIG. 6 is a perspective view of the case insert, showing a fluted section and an adjacent open channel.

Turning to FIGS. 2 and 4, the fluted section 22*b* of the case insert 22, formed near the top end, consists of a plurality of adjacent, vertically parallel recesses, with each recess of the fluted section sized and shaped to receive a tooth 12*ab* of the switch 12*a*. The open channel 22*g* positioned directly below the fluted section 22*b* is similarly sized and shaped to receive the tooth 12*ab*. The inventor notes that while the illustrative socket 100 in the Figures shows the fluted section 22 above the open channel 22*g*, the relative position of these structures can in fact in reversed, with the open channel 22*g* above the fluted section 22, which would affect the functional position of the switch. If the fluted section and open channel positions are reversed, the switch in the uppermost position would position the tooth 12*ab* of the switch 12*a* in the open channel 22*g*, and thus in an unlocked position, and hence the important relationship between the fluted section and the open channel is that one is positioned immediately above the other so as to allow the tooth to move between the two structures. The fluted section 22*b* and the open channel 22*g* shown in the Figures are approximately one quarter length of a total perimeter of the case insert 22, and are a same length, although the inventor notes that the fluted section 22*b* can in fact be formed about the entire perimeter if desired. The open channel 22*g*, however, must have a discreet end or stop to the channel to limit travel distance of the tooth 12*ab* about the perimeter of the case insert 22 and thus cannot be a same perimeter as the case insert 22*b* as measured about a smallest exterior measurement of the case insert.

Figure 10:
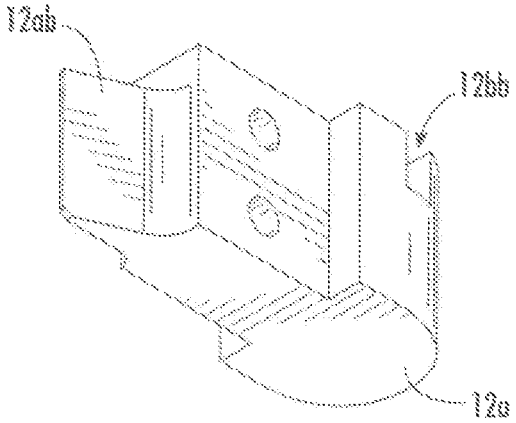
FIG. 10 is a perspective view of the switch, shown with a straight tooth.
Figure 11:
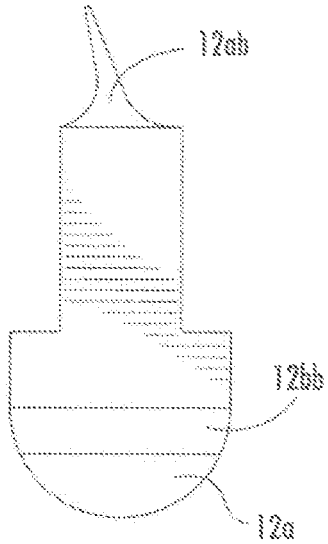
FIG. 11 is a top view of the switch, shown with a bent tooth.
Figure 12:
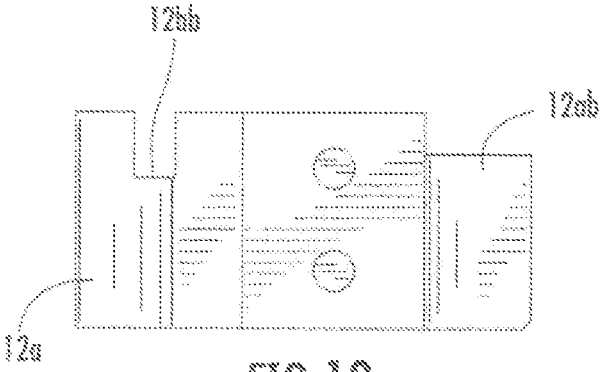
FIG. 12 is a side elevation view of the switch.
Figure 13:
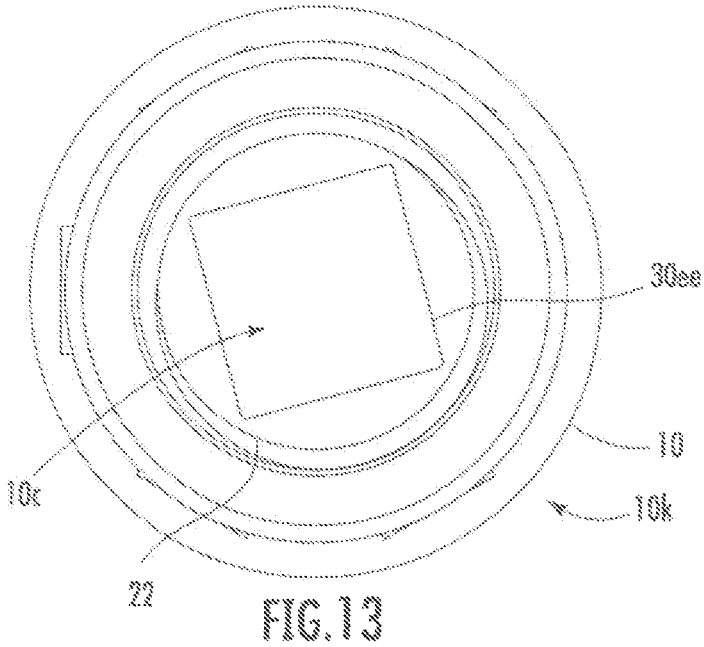
FIG. 13 is a top view of the self-adjusting deep well socket in FIG. 1.

The switch 12*a* is slideably mated to the slot 12*b*, and features a switch groove 12*bb* positioned outside the slot 12*b* and the switch tooth 12*ab* positioned inside the slot 12*b*. The tooth 12*ab* can either be configured as a straight tooth, as shown in FIG. 10, or have an angled or bent shape such that when viewed from a top view, as shown in FIG. 11, where a tip of the tooth is angled towards a left side of the switch 12*a*. The bent shape of the tooth allows the tooth to travel easily in and out of the adjacent recesses of the fluted section 22*b* as the case insert 22 is turned in one direction and the bent shape prevents the case insert rotating in an opposite direction while travelling through the recesses of the fluted section 22*b*. It should be noted that in the illustrative embodiment shown in the Figures, the case insert is ideally turned counterclockwise to secure the socket 100 onto the fastener 400, and hence the tooth 12*ab* is shown bent towards a left side. If the case insert is turned clockwise to secure the socket 100 around the fastener 400, this would require reversing a direction of the internal threads 14*b* 22*a*, and the tooth 12*ab* would be bent towards a right side. The inventor notes that the angle of the tooth shown in FIG. 11 is about 16 degrees, but can be any angle from 0 to about 16 degrees, and stresses that the angle is included to encourage rotation of the case insert 22 in one direction only to tighten the fingers 10*e* around the fastener 400. The inventor notes that the tooth, whether angled or straight, must be able to move inside the fluted section 22*b*; angling the tooth as in FIG. 11 is one way in which such travel is achieved, with the angled tooth flexing slightly as travels, however the inventor notes that the entire switch 12*a* and its tooth 12*ab* could include spring-loaded plates that allow the switch 12*a* and its non-flexing tooth 12*ab* to travel through the individual recesses of the fluted section by moving the tooth outwards when moving across a wall dividing adjacent recesses and hence expanding the springs, and moving the tooth back inwards into an immediately adjacent recess and hence releasing tension on the springs. The inventor believes using spring-loaded plates with the switch 12*a* could eliminate the need for the tooth 12*ab* to flex, and notes that the switch's purpose is to lock the socket around the fastener, and there are other ways in which the tooth 12*ab* can be inserted into the fluted section to achieve locking. The switch 12*a* and its tooth 12*ab* are ideally made of a strong material capable of withstanding torque forces applied to the socket 100 to ensure secure positioning inside the fluted section and yet still allow the tooth 12*ab* to move within the fluted section as desired. The switch groove 12*bb* is designed to receive an optional flat head screwdriver or chisel to help move the switch 12*a* into the open channel 22*g*, if additional force is required to move the switch from the fluted section 22*b* to the open channel 22*g*.

The finger support 22*i* is an annular array of fingers 10*e* supported by an upper ring 22*c* attached to an annular plate 22*h* by a series of parallel, spaced apart vertical struts or arms 22*d*, every pair of adjacent arms defining a finger bay 22*j*. Each arm 22*d* is formed with a hole 22*ee* on opposed sides of the arm 22*d*, either configured as a single through-hole or a pair of channels sized and shaped to receive a pin 22*e*. The finger bay 22*j* receives the finger 10*e*, with each finger 10*e* pivotably affixed to the pair of adjacent arms of its finger bay 22*j* by a pin 22*e* inserted both into a finger hole 22*ek* of the finger 10*e* and to the holes 22*ee* of the adjacent arms. The Figures show an illustrative pin 22*e* and hole 22*ee* 22*ek* relationship that allows the fingers 10*e* to have a pivotable relationship with the adjacent arms 22*d* of the finger bay 22*j*, and modifications to the pin-hole structures shown in the Figures, so long as the finger 10*e* can pivot in its respective finger bay 22*j* are acceptable. Each finger 10*e* is approximately teardrop shaped, with a gripping side 10*eg* facing inwards towards the deep well chamber 10*c*, and a channel side 10*ec* facing the finger channel 14*a*. The gripping side 10*eg* may be further coated with material such as silicone, or have a rough surface to enhance its ability to grip the fastener 400. The finger support 22*i* is positioned inside the case insert 22 at the bottom opening. As previously mentioned, each finger 10*e* can pivot freely about the pin 22*e* and thus enter or move out of the finger channel 14*a* and deep well chamber 10*c*. In some embodiments, the finger support 22*i* welded to the case insert 22, and in others, the finger support 22*i* is optionally formed with a push-in retaining ring (not shown) to allow the finger support to be pressure fitted into the case insert 22.

The teardrop shape of the finger 10*e* has the flattened portion extending towards the uppermost end of the finger 10*e* and allows the tip 22*f* of the case insert 22 to easily slide along the finger 10*e*, displacing the finger's resting position inside the finger channel 14*a* and effectively pushing the gripping side 10*eg* of the finger further into the deep well chamber 10*c*. The inventor notes that the nature of the invention is such that within a same socket, the fingers 10*e* may all be of a same depth, varying depths, or other combinations of depths, with the depth measured from the gripping side 10*eg* to the channel side 10*ec* within a same case body 10, as needed.

Figure 7:
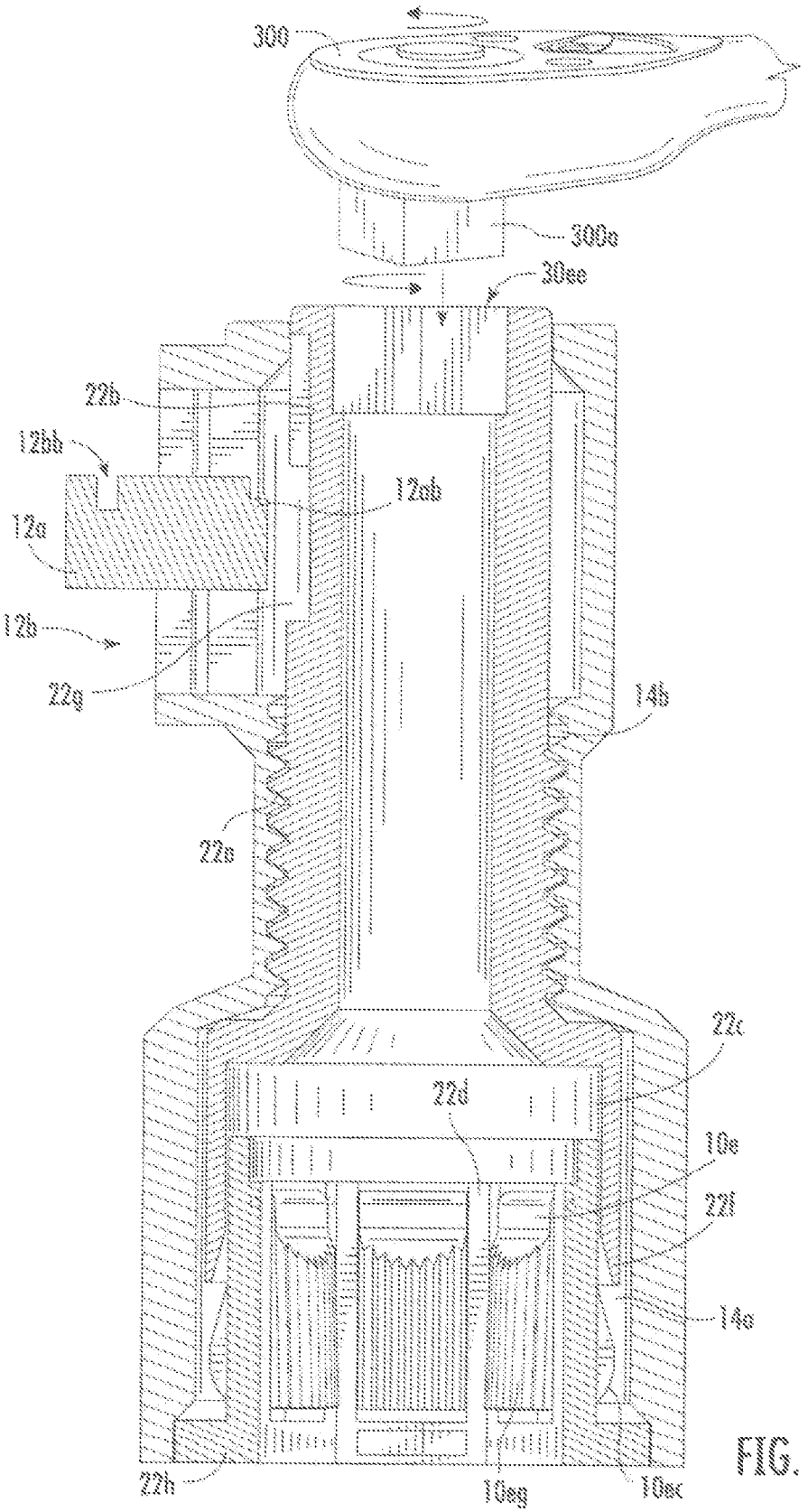
FIG. 7 is a cross sectional view of the self-adjusting deep well socket, taken along lines C-C in FIG. 1, shown with a switch tooth positioned inside an open channel of the case insert (unlocked position), and showing the prior art socket wrench being turned counterclockwise so as to move a tip of the case insert downwards into a finger channel.
Figure 8:
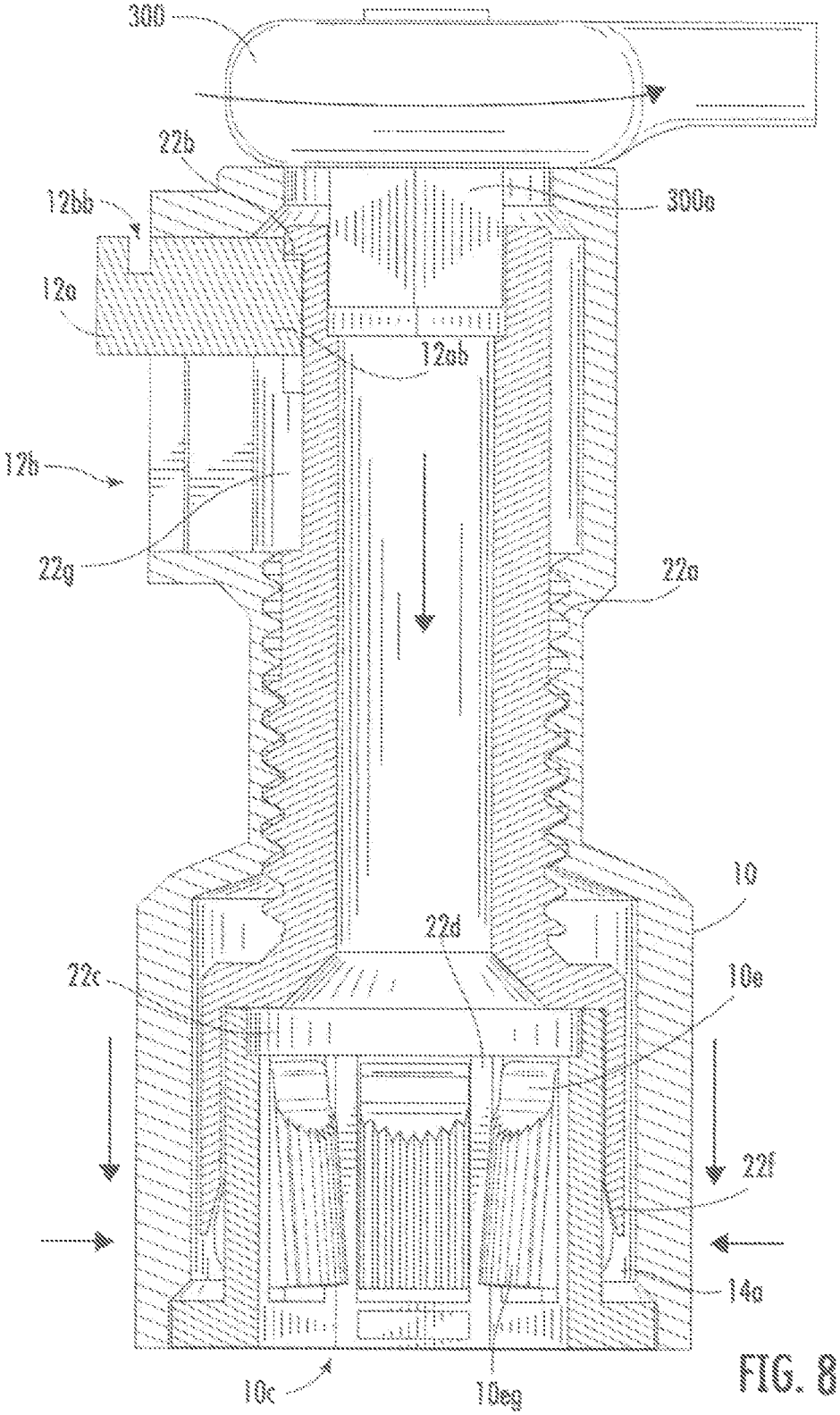
FIG. 8 is a cross sectional view of the self-adjusting deep well socket, taken along lines C-C in FIG. 1, shown with the switch tooth positioned inside a recess of a fluted section of the case insert (locked position), and showing the prior art socket wrench turning counterclockwise, driving the tip of the case insert downwards into the finger channel so as to push the plurality of fingers further into the deep well chamber, and showing as compared to FIG. 7, turning the case insert counterclockwise while the switch tooth is in the fluted section of the case insert ensure that the plurality of fingers, moved into the deep well chamber by driving the tip of the case insert into the finger channel, maintain their tightened position. It should be noted that the fingers can be moved into the deep well chamber regardless of the position of the switch, but only when the switch tooth is in the fluted section of the case insert can the position of the fingers be securely maintained.
Figure 9:
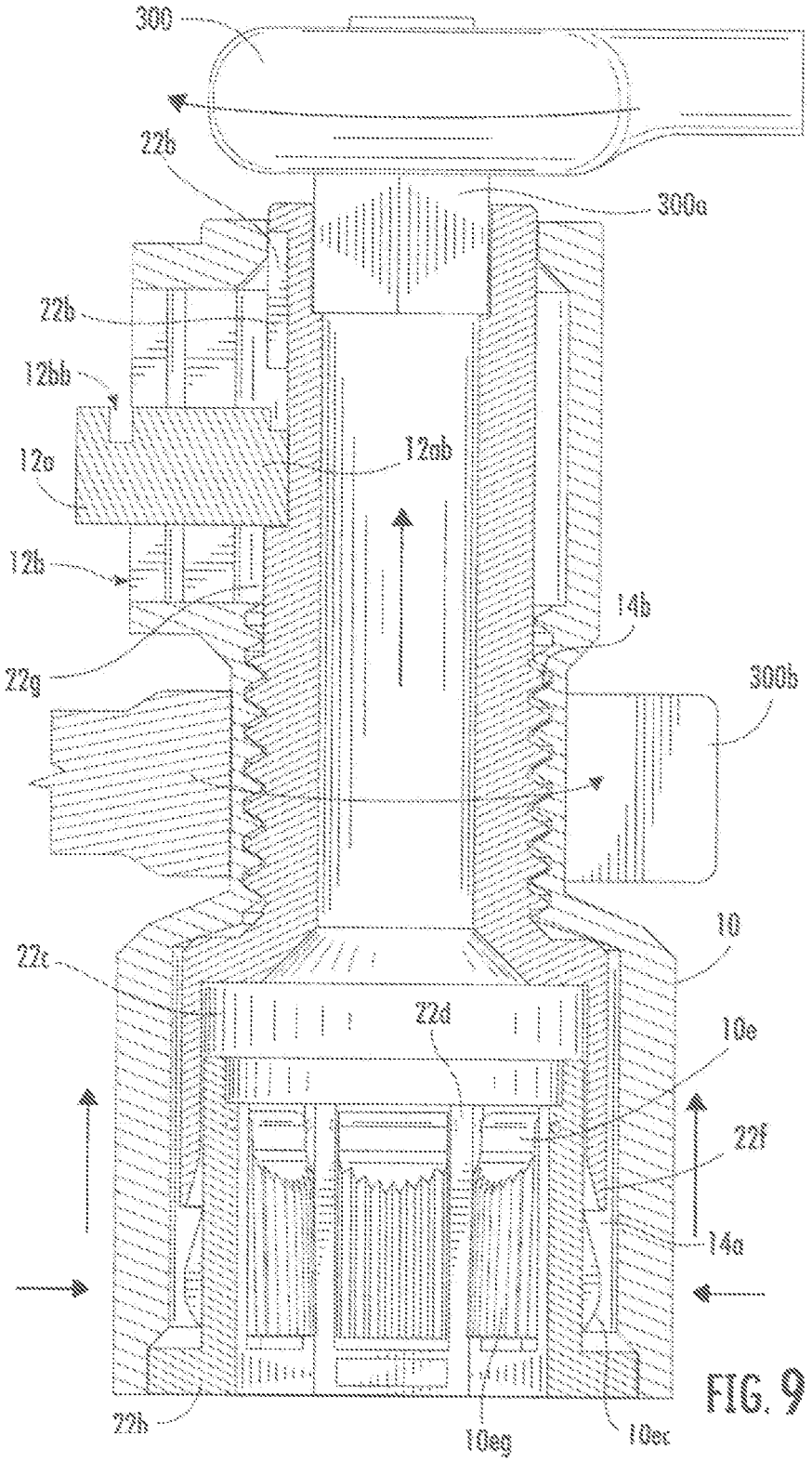
FIG. 9 is a side elevation, cross sectional view of the deep well socket shown in FIG. 1, taken along lines C-C, where the switch tooth is positioned in the open channel below the fluted section (unlocked position). The prior art socket wrench is turned clockwise, and the prior art crescent wrench positioned on to the case body is simultaneously turned counterclockwise or held in place to prevent the case body from rotating, causing the tip of the case insert to move upwards and the plurality of fingers to move back into the finger channel, unlocking the fastener from the socket.

FIGS. 7-9, and FIG. 1 show a method of using the socket 100. The socket 100 is first positioned around the fastener 400 by aligning the deep well chamber 10C at the fastener end 10*i* of the case body 10 over the fastener 400. The switch 12*a* of the socket 100 may be in either the uppermost (FIG. 8) or lowermost position (FIG. 7) in the slot 12*b*. The drive square 300*a* of the prior art socket wrench 300 or other prior art tool is positioned so as to engage the tool receiver 30*ee*; when turned, the tooth 12*ab* moves laterally in a counterclockwise direction, rotating the case insert 22 along the mated threads of the case insert and the case body, rotating the tip 22*f* downwards (FIG. 8). The tip 22*f* displaces the fingers 10*e* in the finger channel 14*a*, pushing the fingers 10*e* into the deep well chamber 10*c* and against a plurality of sides of the fastener 400. To ensure a maximum gripping action of the fingers 10*e* around the fastener 400, the switch 12*a* can then be pushed into the uppermost slot position (FIG. 8) and thus its tooth 12*ab* be positioned inside one of the recesses of the fluted section 22*b*, and then subsequently turned counterclockwise until further torqueing is impossible, and positioning the tooth 12*ab* inside the fluted section 22*b* while turning the case insert 22 counterclockwise ensures maximum tightening of the fingers 10*e* around the fastener 400 and maintains the absolute position of the tooth 12*ab* preventing slipping and loosening (FIG. 8). Rotation of the case insert 22 can only be in the counterclockwise direction when the tooth 12*ab* is in the fluted section 22*b*. When the tooth 12*ab* is moved into the open channel 22*g* (FIGS. 7 and 9) the case insert 22 can be rotated in a clockwise position by turning the drive square 300*a* clockwise (FIG. 9). This causes the tooth 12*ab* to travel along the open channel 22*g*, and loosens the fingers 10*e* around the fastener 400. To maintain the position of the fingers around the fastener 400, the tooth 12*ab* must be pushed into the fluted section 22*b* if the tooth 12*ab* was originally in the open channel 22*g* while the case insert 22 was initially rotated to secure the fingers 10*e* around the fastener 400 (FIG. 7). Note that the case insert 22 can rotate either clockwise or counterclockwise, depending on the tooth 12*ab* location (fluted section or open channel), and can in fact rotate either clockwise or counterclockwise when the tooth 12*ab* is in the open channel 22*g*. Hence, tightening the fingers 10*e* around the fastener 400 can be achieved by rotating the drive square 300*a* counterclockwise, regardless of the position of the tooth 12*ab*, but to secure the fingers 10*e*, the tooth 12*ab* is ideally positioned into the fluted section 22*b*, and to release the fingers 10*e*, the tooth 12*ab* is ideally positioned in the open channel 22*g*.

Since each finger 10*e* moves independently of the other fingers, a deformed or otherwise irregularly shaped fastener 400 can still be gripped tightly on all sides by the fingers 10*e*, as any areas where the fastener shape has been eroded, the fingers 10*e* will simply have more room to extend into the deep well chamber 10*c*. Hence, a lack of a regular fastener shape, such as a hexagon, is no longer a challenge to remove or even replace because the plurality of fingers 10*e* naturally adjust to the shape of the fastener 400. The inventor stresses this is a key feature of his invention, as currently, there are no self-adjusting sockets that can accommodate irregularly shaped fasteners. On the contrary, the prior art sockets are shape specific (hexagonal, square, etc.) and rely on the fasteners having precise shapes including corners and flat surfaces in specific arrangements, such as squares, hexagons, etc. as those corners and flat surfaces are necessary to allow the prior art socket to grip the fastener. The inventor's socket 100, in bold contrast, can just as easily secure irregularly or curvy shaped fasteners as precisely as undamaged hexagonal shaped fasteners because of the adjustable nature of the fingers 10*e*.

To remove the socket 100 from the fastener, the switch 12*a* is moved into the open channel 22*g*. As torqueing the case insert 22 with the tooth 12*ab* positioned inside the fluted recess 22*b* causes the fingers to tightly grip the fastener 400, moving the switch to the open channel may be difficult and thus the groove 12*bb* formed in the switch receives the chisel or screwdriver, that is then struck with a hammer or other tool to force the tooth 12*ab* into the open channel 22*g*. Once the tooth is in the open channel, the drive square 300*a* of the prior art socket wrench 300 is positioned in the tool receiver 30*ee*, and the prior art crescent wrench is positioned on the tool grip 12*c*, and simultaneously turned in opposing directions, where the prior art socket wrench is turned clockwise and the prior art crescent wrench is turned counterclockwise to loosen the fingers 10*e* from the fastener by rotating the case insert 22 upwards.

The socket 100 described herein is useful for use with prior art ratcheting and non-ratcheting socket wrenches 300, and is designed as a substitute for conventional prior art sockets. The inventor believes a set of sockets 100 in standard sizes are most useful, with each socket size based on a prior art standard socket size but with an adjustable fastener range determined by a predetermined depth of the fingers 10*e* measured from the gripping side 10*eg* to the channel side 10*ec* to accommodate a variety of damaged or otherwise irregularly shaped fasteners. In the example shown in the Figures, for a half-inch diameter fastener, the half inch socket is designed to accommodate fasteners from ½ inch to ½ inch, and ideally at least two socket sizes or two or more metric socket sizes. Hence, fewer sockets can be included within a socket set and still cover a full range of fastener sizes, saving on storage space, and material costs. Universal sockets covering more than two standard sizes are achievable by again modifying the predetermined finger depth as well as a diameter of the deep well chamber and a diameter of the finger channel 14*a* and by sizing the case insert, case body and a total thread length of the case body and case insert accordingly to maximize finger travel from the finger channel 14*a* to the deep well chamber 10*c*.

The inventor recommends making his socket invention out of metals, alloys and structural plastic for some or all components. The tooth can be made of a flexible or inflexible strong material, and ultra-high molecular weight plastic is a suitable recommended for the embodiment shown in the Figures where a flexible tooth is used. Since considerable torque is needed to fasten or unfasten a damaged bolt or nut, especially a corroded fastener, the inventor suggests using all or mostly metal components for the socket 100 to ensure a stronger and more durable product. The inventor notes the gripping side of the fingers may also include a coating, such as silicone and/or rubber, pads, or be embossed with a texturized design to enhance the grip of the fingers 10*e*. The inventor also notes that materials used for the various components will also vary depending on whether the socket 100 is for home DIY use or commercial use.

The inventor notes his socket 100 as described in the Figures and above is just one example of how a self-adjusting deep well socket can be secured to and then removed from a damaged or irregularly shaped fastener. He notes that even simpler sockets can be created with a single hexagonal cylindrical socket with the fingers as described above, but with a removable case body that slips over the socket that can be expanded or compressed as needed, in order to push the fingers 10*e* around the fastener in the deep well chamber 10*c*. The inventor also notes that while he believes starting with a hexagonal cylindrical deep well socket shape is ideal, given that the fingers adjust to the shape of the fastener positioned inside the socket when the socket is tightened in place, the socket could also be a simple cylinder with smooth exterior or interior walls with the plurality of fingers and this would work with any shaped fastener, so long as the fingers are wide enough to extend as far as necessary to engage all sides of the fastener.

The inventor believes his socket 100 elegantly solves the vexing problem present in the prior art, namely, the lack of an adjustable-sized socket, and which uses prior art tools for added convenience. The prior art currently only provides sockets of specific dimensions ill designed to accommodate fasteners of irregular shapes and it is notable that with both imperial and metric systems being used around the world, most people end up buying two types of socket sets to cover fasteners from both systems. The socket 100 described herein reduces the overall number of sockets needed and eliminates the differences between metric and imperial systems. Hence, it is to be understood that the above-described arrangements are only illustrative of the application of the principles of the present invention, and numerous modifications and alternative arrangements, such as the ones just described, may be devised by those skilled in the art without departing from the scope of the present invention. Accordingly, any components of the present invention indicated in the drawings or herein are given as an example of possible components and are not meant as a limitation.

What is claimed is:

1. A self-adjusting deep well socket comprising:

a case insert having a tool receiver end sized and shaped to receive a drive square of a socket wrench, an opposed fastener receiver end sized and shaped to receive a threaded fastener, and a deep well chamber extending from the tool receiver end to the opposed fastener receiving end;

a case body having a top end, a bottom end, and an interior wall defining a cavity extending from the top end to the bottom end, the cavity sized and shaped to receive the case insert such that the tool receiver end is positioned at the top end of the case body and in which the case body and the case insert have a coaxial relationship;

a slot having a slot length formed into the case body;

a switch having a switch length and a tooth slideably positioned inside the slot; and a plurality of fingers in an annular array inside the case insert at the fastener receiving end;

wherein the slot length is longer than the switch length;

wherein the case insert is formed with a fluted section immediately above an open channel such that both the fluted section and the open channel are alternately accessible by sliding the tooth within the slot length;

wherein the case insert and an interior wall of the case body are both formed with complementary mating threads;

wherein each finger of the plurality of fingers pivots about an attachment point at an upper end of the annular array; and wherein the plurality of fingers move into the deep well chamber when the case insert is rotated in a first direction along the mated threads towards the fastener receiving end.

2. The adjustable size socket in claim 1, wherein each finger of the plurality of fingers has at least one of a same or varying size predetermined depth as compared to each other finger.

3. The adjustable-size socket in claim 1, wherein the plurality of fingers is supported by an annular support where each finger is independently affixed to the annular support and moves independently of the other fingers in the annular support.

4. The adjustable-size socket in claim 3, wherein the annular support is further comprised of a series of finger bays, each finger bay sized and shaped to receive a finger of the plurality of fingers.

5. The self-adjusting socket in claim 4, further comprising a finger channel positioned between the interior wall of the case body and the annular support.

6. The self-adjusting socket in claim 1, wherein each finger of the plurality of fingers is further comprised of a gripping side facing the deep well chamber.

7. The self-adjusting socket in claim 1, wherein each finger tapers from the attachment point to a lowermost part of the finger so as to resemble on a side of each finger facing the finger channel.

8. The self-adjusting socket in claim 1, wherein the open channel has a predetermined length measuring less than a perimeter measurement of the case insert.

9. The self-adjusting socket in claim 1, wherein the case insert pushes the plurality of fingers into the deep well chamber when the case insert is rotated towards the fastener receiver end of the case body.

10. The self-adjusting socket in claim 9, wherein at least one of the fingers of the plurality of fingers is positioned further into the deep well chamber relative to another finger of the plurality of fingers.

11. The self-adjusting socket in claim 1, wherein the tooth is angled.

12. The self-adjusting socket in claim 1, wherein at least one of the tooth and the fluted section is made of ultra-high molecular weight plastic.

13. The self-adjusting socket in claim 12, wherein the tooth is flexible.

14. The self-adjusting socket in claim 1, wherein at least one of the tooth and the case body is made of metal.

15. The self-adjusting socket in claim 14, wherein the switch is further comprised of spring loaded plates.

16. The self-adjusting socket in claim 1, wherein the deep well chamber, the plurality of fingers, and the finger channel are sized such that a single self-adjusting socket accommodates a plurality of fasteners whose diameter sizes include two standard socket sizes.

17. The self-adjusting socket in claim 1, wherein the self-adjusting socket is a universal socket and the deep well chamber, the plurality of fingers, and the finger channel are sized to accommodate a plurality of fasteners whose diameter sizes include three or more standard socket sizes.

* * * * *